US005529506A

United States Patent [19]

Onoda

[11] Patent Number: 5,529,506

[45] Date of Patent: Jun. 25, 1996

[54] TERMINAL FOR SHIELDING CONNECTORS AND SHIELDING CONNECTOR

[75] Inventor: Katsuhiko Onoda, Haibara-gun, Japan

[73] Assignee: Yazaki Corporation, Tokyo, Japan

[21] Appl. No.: 234,864

[22] Filed: Apr. 28, 1994

[30] Foreign Application Priority Data

Apr. 28, 1993 [JP] Japan ..... 5-102701

[51] Int. Cl.[6] ..... H01R 4/66

[52] U.S. Cl. ..... 439/95

[58] Field of Search ..... 439/95, 98, 609, 439/610, 877

[56] References Cited

U.S. PATENT DOCUMENTS 3,221,294 11/1965 Roberts ..... 439/877

4,641,911 2/1987 Pavlak et al. ..... 439/877 X

FOREIGN PATENT DOCUMENTS 2-18533 5/1990 Japan .

*Primary Examiner*—P. Austin Bradley

*Assistant Examiner*—Daniel Wittels

*Attorney, Agent, or Firm*—Armstrong, Westerman, Hattori, McLeland & Naughton

[57] ABSTRACT

A terminal is provided which is assembled in shielding connectors used for electric wiring of a vehicle. The terminal is formed by folding a conductive plate and has at one side an electric contact portion (1) and drain wire crimp flaps (3) and at the other side a shielded cable-holding flaps (2) and shielding contact portions (5) each with a resilient contact piece (6). The terminal enables an easy and secure connection between a shielding wire and a shielding case as well as facilitated assembly, and is reliable. A shielding connector using such a terminal is also provided.

5 Claims, 5 Drawing Sheets

TERMINAL FOR SHIELDING CONNECTORS AND SHIELDING CONNECTOR

BACKGROUND OF THE INVENTION

1. Field of the Invention

This invention relates to a terminal mounted in a shielding connector used for electric wiring of a vehicle and to a shielding connector. "Shielding connector" used herein is intended to mean a connector with a structure that provides connections for the inner conductor of a shielded cable and for the shielding layer of the cable at a time.

2. Description of the Prior Art

A shielded cable such as a coaxial cable or multicored shielded cable includes at an outer layer portion a shielding layer formed of a braided conductor. When such a shielded cable is connected to an electric instrument or to another shielded cable, it is necessary that not only the conductor but also the shielding layer be connected.

In order for a shielding layer to be connected, part of the outer sheath is conventionally removed to expose the shielding layer, followed by twisting of the exposed layer into a single wire. The wire is then at its front end soldered, or screwed via a terminal attached to its front end, to a shielding case or the like.

The connecting operation according to the above, however, is exceedingly inefficient.

To make an improvement in connecting means of shielding layers, as shown in FIG. 2 Japanese Utility Model Publication No. Hei 2-18533 proposes a shielding connector k in which a drain wire b electrically connected to a shielding layer a of a cable c is connected to a shielding case e of a mating housing via a shielding terminal d crimped on the drain wire b.

If, however, the shielding terminal d is directly crimped on the drain wire b as in the shielding connector k, a friction is caused between an edge g of the rear crimp portion f of the terminal d and the drain wire 6 as shown in FIG. 8 by the swinging of the drain wire b due to vibration and the like in use, resulting in possible severance of the drain wire b.

To prevent the severance by friction, it must be arranged for example that as shown in FIG. 9 the rear crimp portion f is crimped on the drain wire b via a flexible tube h through which the wire b is passed. This exceedingly lowers the operability.

SUMMARY OF THE INVENTION

This invention has been accomplished to overcome the above drawback and its object is to provide a reliable terminal for shielding connectors and a shielding connector, which enable an easy and secure connection between a shielding wire and a shielding case, and which are excellent in operability for assembly.

In order to attain the object, according to an aspect of this invention, there is provided a terminal for shielding connectors formed from a conductive plate in one piece, which comprises: a forward electric contact portion for contact with a mating terminal, a drain wire crimp flap crimped on a drain wire leading from a shielding layer of a shielded cable, shielded cable-holding means located at a position rearwardly of the drain wire crimp flap for holding the shielded cable, and contact means for shielding.

According to another aspect of this invention, there is provided a shielding connector which comprises: a terminal housing provided with a plurality of terminal accommodating chambers, a shielding case that houses the terminal housing, and a terminal mounted in the terminal housing, the terminal comprising a forward electric contact portion inserted in one of the terminal accommodating chambers for contact with a mating terminal, a drain wire crimp flap crimped on a drain wire leading from a shielding layer of a shielded cable, shielded cable-holding flaps crimped on an outer sheath of the shielded cable at a position rearwardly of the drain wire crimp flap, and contact means for shielding, wherein the contact means for shielding is brought into contact with the shielding case on assembling the terminal housing into the shielding case.

The terminal for shielding connectors has, in addition to a drain wire crimp flap, a shielded cable holding means. Thus, the drain wire electrically connected with the shielding layer of a shielded cable is connected to the terminal by crimping with the drain wire crimp flap, while the shielded cable holding means is crimped on the outer sheath of the cable to hold the cable. Consequently, the shielded cable is fixedly held by the shielded cable-holding means, thereby excluding friction between an edge of the crimp flap and the drain wire caused by friction and the like in use and possible severance of the drain wire.

Further, in the shielding connector of this invention, the connection between the shielding layer of a shielded cable and the shielding case is made when the contact means for shielding of the terminal is brought into contact with the shielding case. As a result, it becomes possible that on fitting into the shielding case the terminal housing having the terminal assembled therein, the contact means for shielding is contacted with the shielding case to effect shielding.

Further objects and advantages of this invention will be apparent from the following description of the Preferred embodiment of the invention as illustrated in the accompanying drawings.

DETAILED DESCRIPTION OF PREFERRED EMBODIMENT

Figure 1:
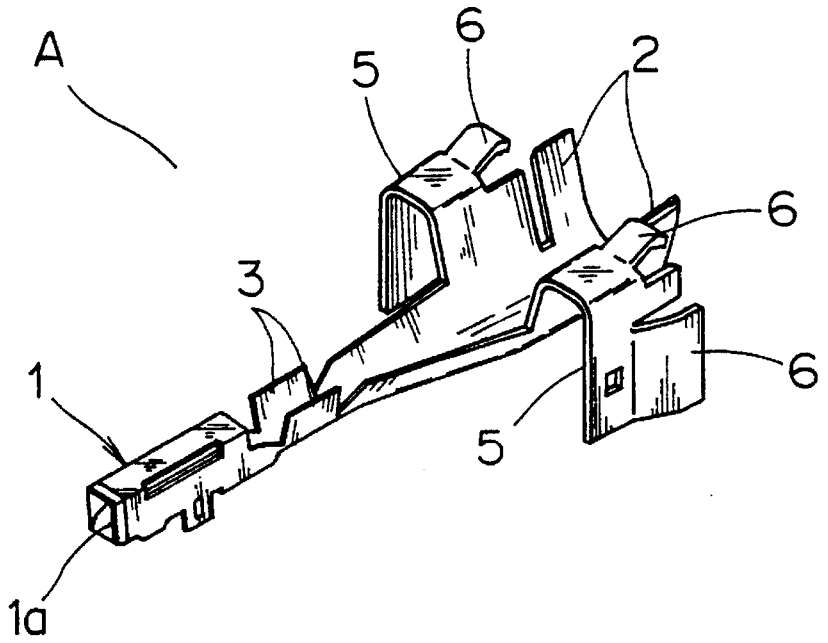
FIG. 1 is a perspective view of a terminal for shielding connectors as one embodiment of this invention.

FIG. 1 is a perspective view of a terminal A for shielding connectors according to one embodiment of this invention.

The terminal A—which is formed by folding a conductive plate of metal such as brass through press processing —has at one end a female electric contact portion 1 for receiving a mating terminal and at the other end a pair of opposed shielded cable-holding flaps 2, 2. At intermediate portions, the terminal A has a pair of opposed drain wire crimp flaps 3, 3 and shielding contact portions 5, 5 folded to have a legs-shape.

The electric contact portion 1 has an electric contact piece 1*a* extended from its front end and folded back into the electric contact portion 1.

The shielding contact portions 5 are shaped so as to be adapted to a later-described shielding case and each has resilient contact pieces 6 cut and raised at its outer and upper sides.

Figure 2:
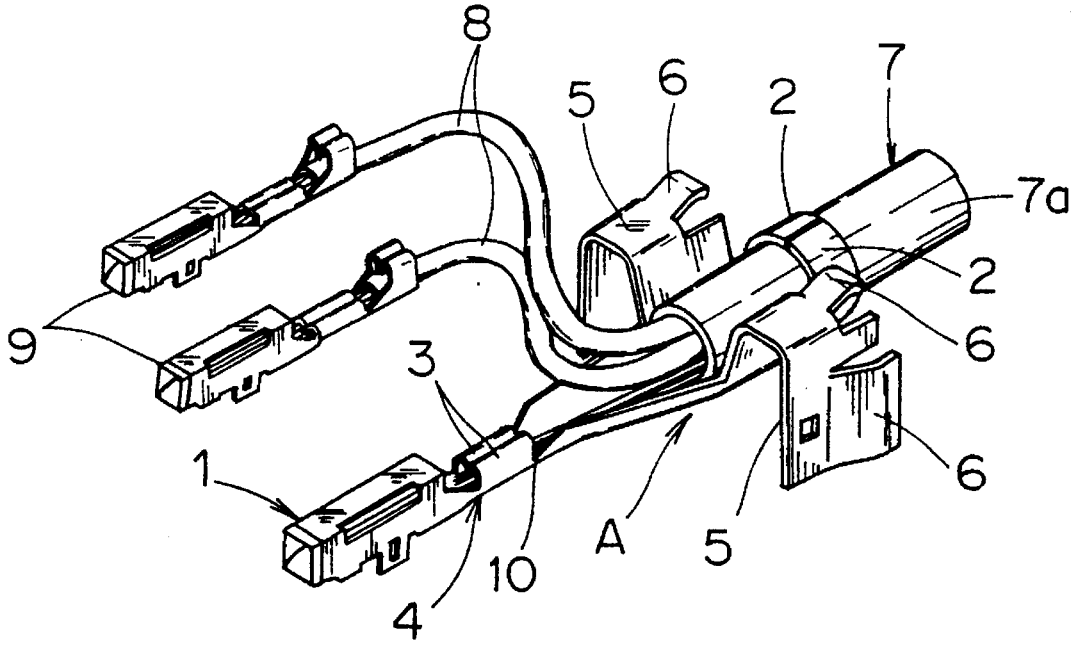
FIG. 2 is a perspective view of the terminal of FIG. 1 with a shielded cable attached thereto.

FIG. 2 is a perspective view of a shielded cable 7 attached to the terminal A as mentioned above. A drain wire (exposed conducting wire) 10 leading from the shielding layer of the shielded cable 7 is connected to the terminal A by the crimp flaps 3 crimped on the drain wire 10. The shielded cable holding flaps 2 are crimped on the outer sheath 7*a* of the shielded cable 7 to hold the shielded cable 7. A female terminal 9 is attached to each of the covered wires 8 inside the shielded cable 7.

Description is now made of the steps for mounting the above-obtained shielded cable-attached terminal A in a shielding connector S (later described).

Figure 3:
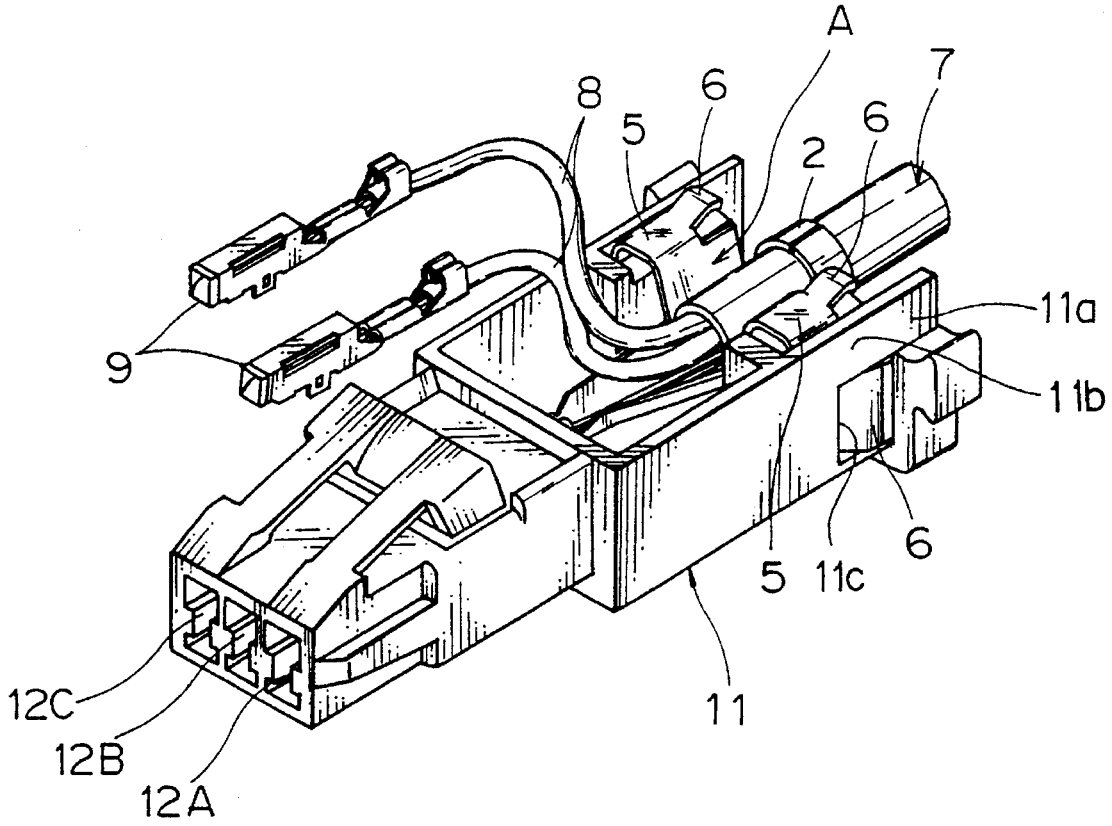
FIG. 3 is a perspective view showing the terminal of FIG. 2 mounted in the terminal housing of a shielding connector.

FIG. 3 shows the shielded cable-attached terminal A disposed in a terminal housing 11, a constituent of the shielding connector S.

The terminal housing 11 has at the front end portion a plurality (three in the embodiment shown) of terminal accommodating chambers 12A, 12B and 12C, and at the rear end portion a shielded cable-mounting portion 11a wherein the shielding contact portions 5 of the terminal A are accommodated.

The electric contact portion 1 of the terminal A is inserted into the central terminal accommodating chamber 12B (not shown), and the female terminals 9 attached to the covered wires 8 are inserted into the other terminal accommodating chambers 12A and 12C.

The shielding contact portions 5 of the terminal A are fitted between the side walls 11*b* of the shielded cable-mounting portion 11*a*, and the lateral resilient contact pieces 6 project outwardly of the side walls 11*b* through respective openings 11*c* formed therein. The upper resilient contact pieces 6 are raised beyond the top of the side walls 11*b*.

Figure 4:
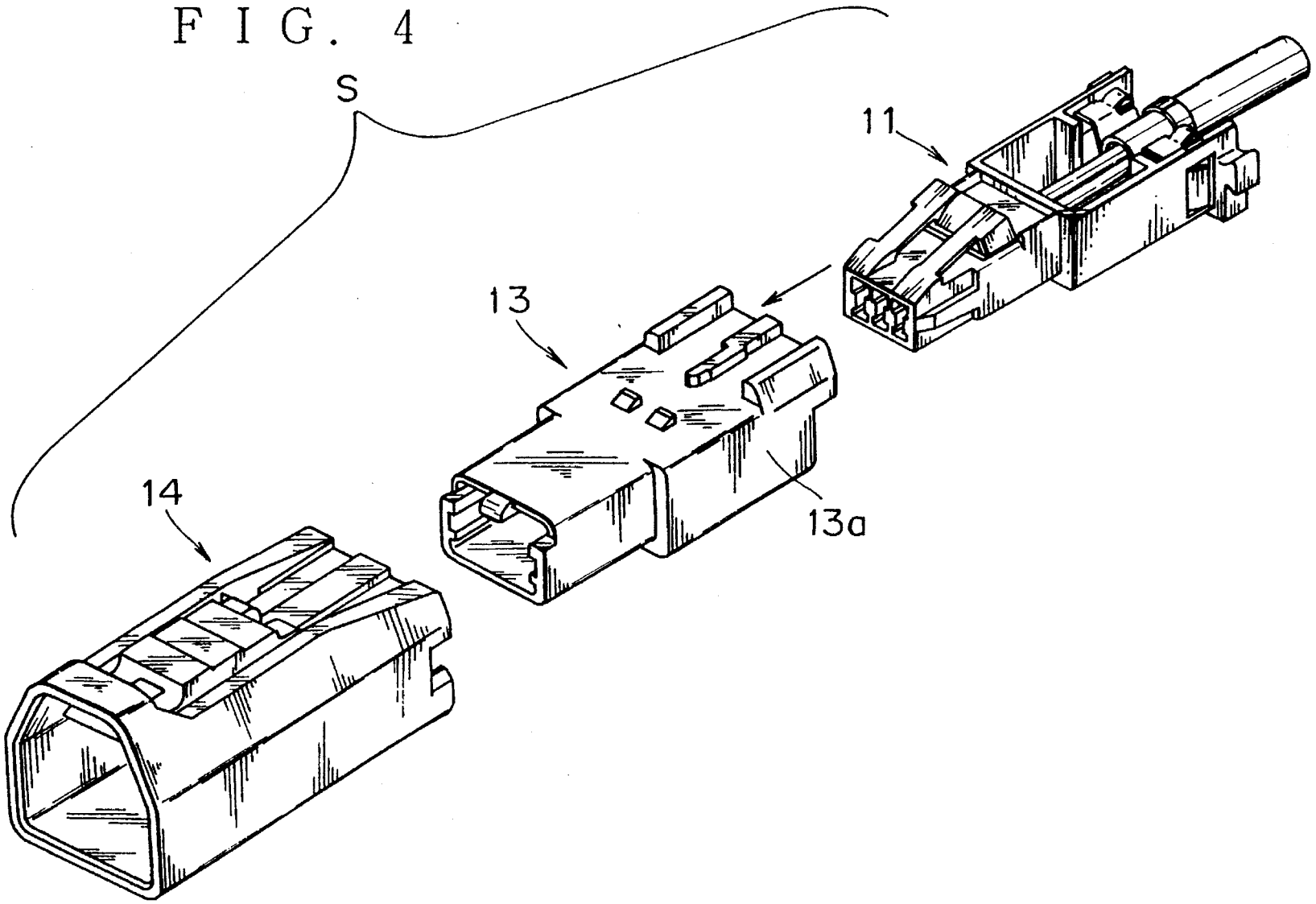
FIG. 4 is a perspective view of a shielding connector as one embodiment of this invention with its constituents, terminal housing, shielding case and housing cover shown disassembled.

FIG. 4 is a perspective view of the shielding connector S according to one embodiment of this invention, with its constituents, terminal housing 11, shielding case 13 and housing cover 14 shown separated.

The terminal housing 11 with the shielded cable-attached terminal A assembled thereon on is fitted into the shielding case 13 as indicated by an arrow in FIG. 4. In this instance, the shielding case 13 is usually first assembled into the housing cover 14, followed by fitting the terminal housing 11 into the shielding case 13, although the shielding case 13 is shown separated from the housing cover 14 in FIG. 4.

Figure 5:
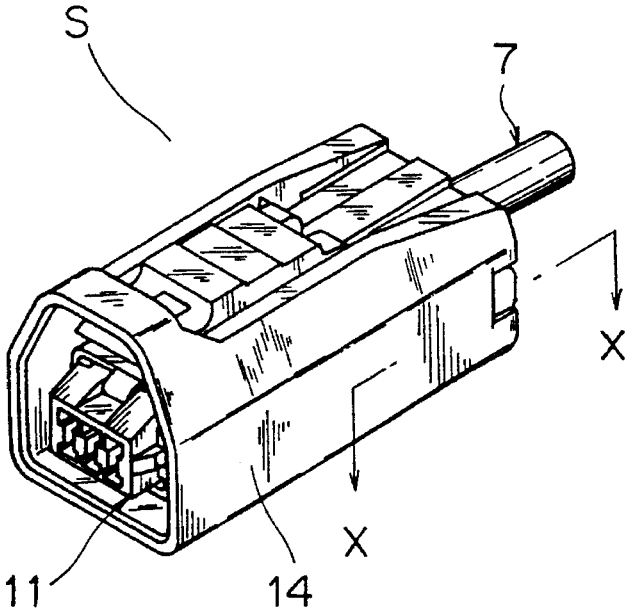
FIG. 5 is a perspective view of the shielding connector of FIG. 4, shown assembled.

FIG. 5 is a perspective view of the shielding case 13 and terminal housing 11 assembled into the housing cover 14.

Figure 6:
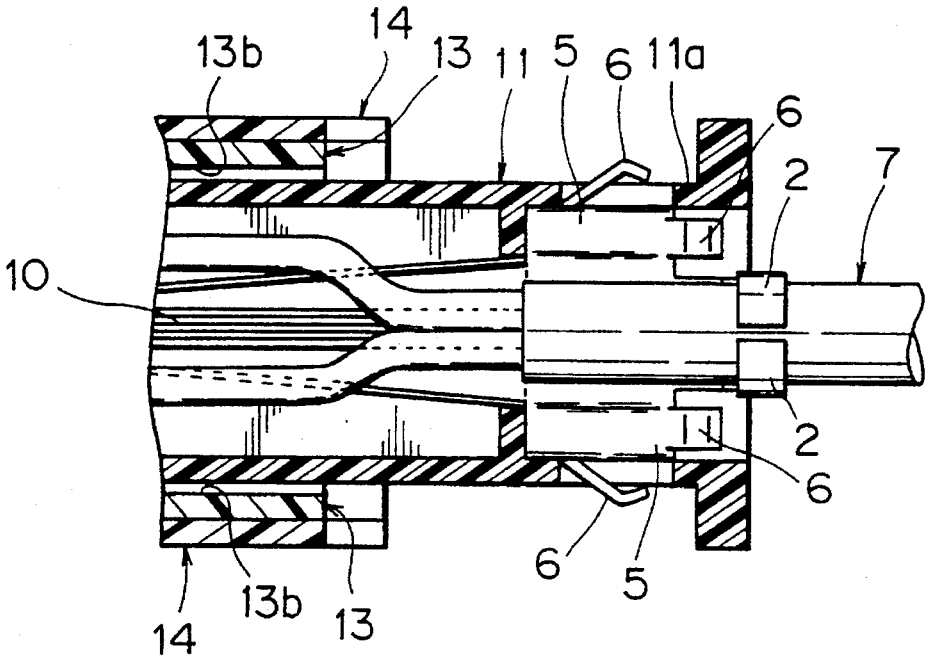
FIG. 6 is a sectional view taken along the line X—X of FIG. 5.
Figure 7:
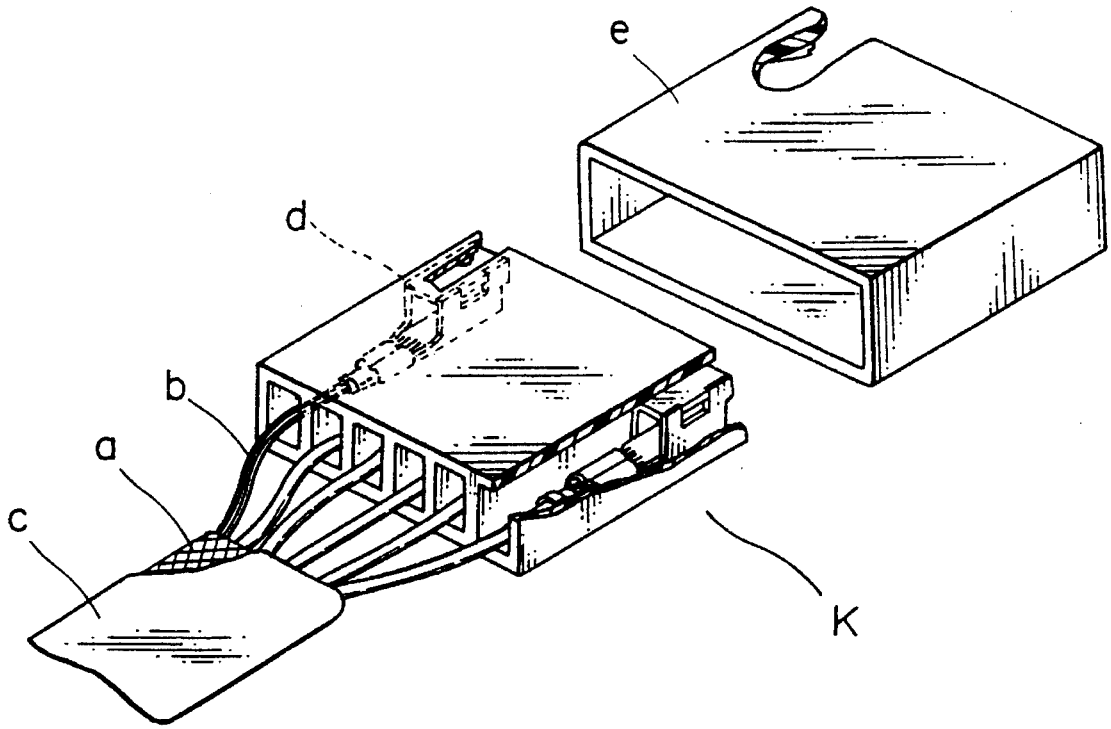
FIG. 7 PRIOR ART
FIG. 7 is a perspective view of a conventional shielding connector.
Figure 8:
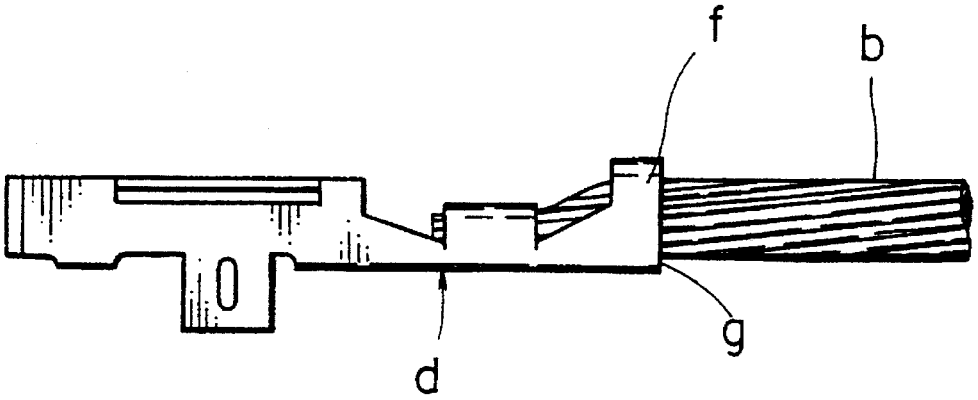
FIG. 8 PRIOR ART
FIG. 8 is a side view showing the junction of the drain wire and the terminal in FIG. 7.
Figure 9:
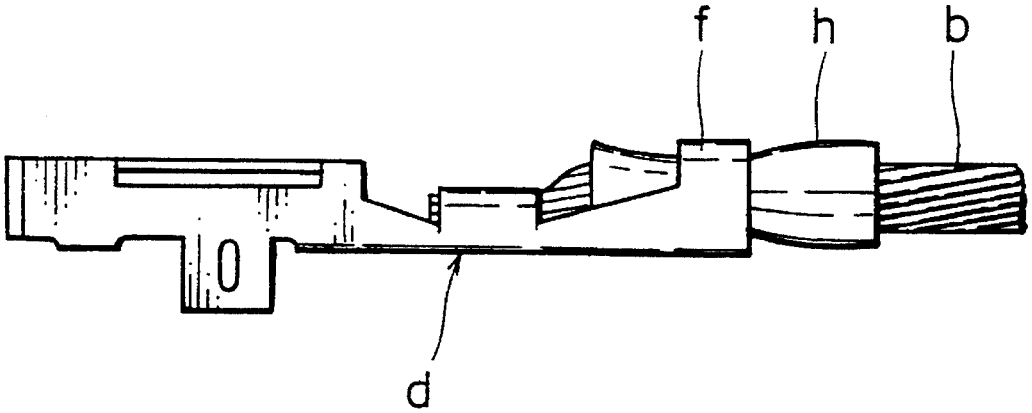
FIG. 9 PRIOR ART
FIG. 9 is a side view showing one example of conventional means for protecting the drain wire at the juntion of FIG. 8.

The shielding case 13, as shown in FIG. 6, includes a hollow circumferential wall 13*a* fabricated from a synthetic resin material and a conductive layer (not shown) metallized on a surface 13*b* of the circumferential wall 13*a*. The circumferentail wall 13*a* may optionally be formed from a metal plate. The shielding case 13 houses the entire terminal housing 11 to effect shielding. On insertion of the terminal housing 11 into the shielding case 13, the resilient contact pieces 6 of the terminal A project outwardly of the terminal housing 11 and resiliently contact the conductive layer on the shielding case 13 or the metal plate constituting the shielding case 13, so that the drain wire 10 of the shielded cable 7 is connected with the shielding case 13 via the terminal A.

The housing cover 14 is fabricated from an insulating synthetic resin material and houses the shielding case 13 (and the terminal housing 11 assembled therein) for its protection and electrical insulation against the outside.

As described above, this invention has the following features and advantages. Since the terminal for shielding connectors is provided with shielded cable-holding flaps in addition to the drain wire crimp flaps, the crimp flap-crimped drain wire is fixedly held by the shielded cable-holding flaps, thereby excluding friction between an edge of the crimp flaps and the drain wire caused by vibration in use and possible unfavorable phenomena such as severance of the drain wire. Further, owing to the structure whereby the shielding contact pieces resiliently contact the shielding case, the shielding wire is connected to the shielding case on fitting the terminal housing into the shielding case in the housing cover, resulting in a marked improvement in operability for assembling the shielding connector.

In addition, since the electric contact portion and the shielding wire crimp flaps may be provided in shape similar to those of terminals attached to electric wires other than the shielding wire, the pressure-welding of the shielding wire to the terminal may be effected concurrently with the pressure-welding of other electric wires, advantageously resulting in an improvement in productivity and reliability.

What is claimed is:

1. A shielding connector, comprising:

a terminal housing provided with a plurality of terminal accommodating chambers;

a shielding case that houses said terminal housing; and a terminal mounted in said terminal housing, said terminal including a forward electric contact portion inserted in one of said terminal accommodating chambers for contact with a mating terminal, a drain wire crimp flap crimped on a drain wire leading from a shielding layer of a shielded cable, shielded cable-holding flaps crimped on an outer sheath of said shielded cable at a position rearwardly of said drain wire crimp flap, and contact means for shielding, wherein said contact means for shielding is brought into contact with said shielding case on assembling said terminal housing into said shielding case, wherein said contact means for shielding is located at a position between said drain wire crimp flap and said shielded cable-holding flaps.

2. A shielding connector according to claim 1, where-in said contact means for shielding comprises a pair of oppositely located resilient contact pieces each projecting outwardly of said terminal housing through a respective opening formed therein.

3. A shielding connector according to claim 1, where-in said shielding case is formed from a synthetic resin material and provided on a surface thereof with a conductive layer for contact with said resilient contact piece of said contact means for shielding.

4. A shielding connector according to claim 1, where-in said shielding case is formed from a conductive plate of metal.

5. A shielding connector according to claim 1, further comprising a housing cover into which said shielding case and said terminal housing are assembled.

* * * * *